US011927201B2

(12) United States Patent
Zheng

(10) Patent No.: US 11,927,201 B2
(45) Date of Patent: Mar. 12, 2024

(54) INTEGRATED WATER FITTING ASSEMBLY

(71) Applicant: Xiamen Huierjie Sanitary Ware Technology Co., Ltd., Xiamen (CN)

(72) Inventor: Xiangji Zheng, Xiamen (CN)

(73) Assignee: Xiamen Huierjie Sanitary Ware Technology Co., Ltd., Xiamen (CN)

( * ) Notice: Subject to any disclaimer, the term of this patent is extended or adjusted under 35 U.S.C. 154(b) by 0 days.

(21) Appl. No.: 17/704,016

(22) Filed: Mar. 25, 2022

(65) Prior Publication Data

US 2022/0349424 A1 Nov. 3, 2022

(30) Foreign Application Priority Data

May 1, 2021 (CN) ..... 202110486143.8
May 1, 2021 (CN) ..... 202110486148.0

(51) Int. Cl.

| | |
|---|---|
| ***F04D 29/66*** | (2006.01) |
| ***E03D 1/34*** | (2006.01) |
| ***E03D 5/01*** | (2006.01) |
| ***F04D 29/42*** | (2006.01) |

(52) U.S. Cl.

CPC ..... *F04D 29/669* (2013.01); *E03D 1/34* (2013.01); *E03D 5/01* (2013.01); *F04D 29/426* (2013.01)

(58) Field of Classification Search

CPC ..... F04D 29/669; F04D 29/426; F04D 13/01; E03D 1/34; E03D 5/01

See application file for complete search history.

(56) References Cited

U.S. PATENT DOCUMENTS

| | | | | |
|---|---|---|---|---|
| 5,502,845 | A | 4/1996 | Hayashi et al. | |
| 9,650,774 | B2 * | 5/2017 | Zheng | E03D 1/302 |
| 2016/0281343 | A1 * | 9/2016 | Miyake | E03D 5/10 |

FOREIGN PATENT DOCUMENTS

| | | | |
|---|---|---|---|
| CN | 209243848 U | * | 8/2019 |
| CN | 209243848 U | | 8/2019 |
| CN | 112031104 A | | 12/2020 |
| JP | 2016180244 A | | 10/2016 |

* cited by examiner

*Primary Examiner* — Christine J Skubinna

(74) *Attorney, Agent, or Firm* — Bayramoglu Law Offices LLC

(57) ABSTRACT

An integrated water fitting assembly includes a housing, a drainage mechanism, a dual-outlet micro-pump, and a drainage base. The drainage mechanism and the dual-outlet micro-pump are disposed in the housing, the drainage base is disposed below the housing, a water inlet, a washing water outlet, and a drainage control water outlet communicated with each other are formed in the dual-outlet micro-pump, moreover, the water inlet is communicated with a water source, the washing water outlet extends out of the housing, and the drainage control water outlet is connected inside the drainage mechanism. An integrated water fitting assembly further includes a housing, a drainage mechanism, a dual-head flow distribution assembly, a micro-pump, and a drainage base. A water inlet of the micro-pump is communicated with a water source. A flow water inlet, a washing water outlet, and a drainage control water outlet are formed in the dual-head flow distribution assembly.

19 Claims, 16 Drawing Sheets

INTEGRATED WATER FITTING ASSEMBLY

CROSS REFERENCE TO THE RELATED APPLICATIONS

This application is based upon and claims priority to Chinese Patent Application No. 202110486148.0, filed on May 1, 2021, and Chinese Patent Application No. 202110486143.8, filed on May 1, 2021, the entire contents of which are incorporated herein by reference.

TECHNICAL FIELD

The present disclosure relates to the technical field of sanitary ware and, in particular, relates to an integrated water fitting assembly.

BACKGROUND

In the existing toilet design, a toilet needs to be flushed and washed. A drainage control pump is used for control to flush the toilet. A washing pump is used for control to wash the wall of the toilet. However, based on the requirements of the two functions, the existing drainage control pump and the washing pump are independently and respectively arranged in a water tank, which requires a large space, high cost, and troublesome installation and after-sales services.

In addition, there are the following design problems in the design of the toilet:

1. When working, the drainage control pump is affected by the water level in the water tank. If the water level in the water tank is too low, especially lower than an interface of a water inlet of the drainage control pump, suction fails and an impeller idles thereby resulting in the failure of the drainage control pump.
2. Modern toilets tend to adopt the design of sunken water tanks due to the need for aesthetics. A jet port uses water potential energy in a sunken receiving cavity during flushing. Since the water potential energy of the sunken water tanks is small, there are high requirements for the manufacturing process of a flushing line of the toilet. In some cases, the manufacturing process of the toilet is poorly controlled, which can easily lead to insufficient flushing jet force, such that the toilet cannot be washed clean.
3. An existing miniature brushless direct current (DC) water pump is used in the toilet. Under normal circumstances, a water inlet of an end cover outputs water in a container to a water outlet. If the water outlet of the end cover is connected to a tubing, when the pressure of residual liquid in the tubing at the water outlet of the end cover is balanced with the pressure of water in the toilet at the water inlet of the end cover, an air-filled sealed space is formed in a water-passing cavity, which causes "air trapping". At this time, a negative pressure generated by the pump impeller in the air-filled sealed space during operation is not sufficient to break the pressure balance, which will lead to the idling of the impeller, the failure of the pump, and the failure of a function of outputting water from the water inlet to the water outlet.
4. The existing toilet water fitting assembly has a single function and cannot satisfy the needs of various functions.

Therefore, it is necessary to further improve structures of the existing toilet water fitting assembly and smart toilets to solve the above problems.

SUMMARY

An objective of the present disclosure is to provide an integrated water fitting assembly, so as to divide a water source into two paths to be respectively used for drainage and washing, which is simple in structure through integrated design and is convenient for installation and after-sales services. To achieve the above objective, the present disclosure adopts the following technical solution:

An implementation solution I divides a water source into two paths through a dual-outlet micro-pump and a specific technical solution is as follows:

An integrated water fitting assembly provided by the present disclosure includes a housing, a drainage mechanism, a dual-outlet micro-pump, and a drainage base. The drainage mechanism and the dual-outlet micro-pump are disposed in the housing, the drainage base is disposed below the housing, a water inlet, a washing water outlet, and a drainage control water outlet that are communicated with each other are formed in the dual-outlet micro-pump; moreover, the water inlet is communicated with a water source, the washing water outlet extends out of the housing, the drainage control water outlet is connected inside the drainage mechanism, and the drainage mechanism controls open or closing of a water outlet of the drainage base.

The dual-outlet micro-pump may include a water-passing cavity, a rotatable rotor shaft may be arranged in the water-passing cavity, an impeller may be disposed on the rotor shaft, the water inlet, the washing water outlet, and the drainage control water outlet may be all communicated with the water-passing cavity; moreover, the water inlet may be formed at a bottom of the dual-outlet micro-pump, and the washing water outlet and the drainage control water outlet may be eccentrically formed on a side wall.

Preferably, a pressure relief hole may be formed above the washing water outlet or the drainage control water outlet.

The impeller may be of a spiral type, and the washing water outlet and the drainage control water outlet may be inclined outward in a water flow conveying direction of the impeller.

Further, the drainage control water outlet of the dual-outlet micro-pump may have a head of 3-10 m, and a flow rate of 3-10 L/min. The washing water outlet may have a head of 3-5 m, and a flow rate of 12-18 L/min.

The drainage mechanism may include a valve body, a return spring, a piston, and water-sealing rubber; moreover, the piston may be slidably arranged in the valve body to divide the valve body into an upper cavity and a lower cavity. Additionally, the lower cavity may be a drainage liquid cavity communicated with a water inlet of the valve body and the return spring may be disposed in the upper cavity. A bottom of the piston may extend out of the valve body and may be connected with the water-sealing rubber; moreover, the water-sealing rubber may be sealed and adapted with the water outlet of the drainage base. An installation plate may be connected below the water inlet in an outer wall of the valve body and the dual-outlet micro-pump may be fixed on the installation plate to connect the drainage control water outlet to the water inlet of the valve body.

A water supplement tube and/or a water leakage tube may be further arranged on the drainage base; also, the water supplement tube and the water leakage tube may be communicated with the water outlet of the drainage base. Additionally, the washing water outlet may be connected with a washing tubing.

Preferably, the integrated water fitting assembly may further include a plurality of flushing aid tubes. Each of the flushing aid tubes may include an inlet end connected with a pressurized water source end, and an outlet end inserted into the drainage base and connected with the water outlet of the drainage base. Each of the flushing aid tubes may be a venturi tube, and the venturi tube may have a gradually reduced diameter. The pressurized water source end may be a flushing aid pump, the flushing aid pump may be integratedly disposed in the housing or may be disposed on a side of the drainage base outside the housing, the inlet end of each of the flushing aid tubes may be connected to the flushing aid pump through a flushing aid tubing, an anti-siphon hole may be formed in an upper part of the flushing aid tubing, and the anti-siphon hole may be higher than a working water level set in the water cavity. A water-passing cavity of the flushing aid pump may be arranged inside the flushing aid pump, an impeller of the flushing aid pump may be located in the water-passing cavity of the flushing aid pump, and a water inlet and a water outlet of the flushing aid pump may be both communicated with the water-passing cavity of the flushing aid pump.

In another implementation, the pressurized water source end may be an external tap water supply tube and a solenoid valve may be arranged on the tap water supply tube.

The housing may include an upper housing and a lower housing assembled and connected with the upper housing, the dual-outlet micro-pump may be arranged on the lower housing, and a filter screen may be arranged at a position of the water inlet of the dual-outlet micro-pump. Snapping members may be arranged on two sides of an outer wall of the upper housing and each of the snapping members may include a middle part fixedly connected to the upper housing and two ends being cantilevers. Each of the snapping members may include an upper end being a pressing part, and a lower end clamped with the drainage base.

An implementation solution II divides a water source into two paths through a dual-head flow distribution assembly and a specific technical solution is as follows:

An integrated water fitting assembly provided by the present disclosure includes a housing, a drainage mechanism, a dual-head flow distribution assembly, a micro-pump, and a drainage base. The drainage mechanism, the dual-head flow distribution assembly, and the micro-pump are disposed in the housing; moreover, the drainage base is disposed below the housing. Also, a water inlet of the micro-pump is communicated with a water source, a flow water inlet, a washing water outlet, and a drainage control water outlet that are communicated with each other are formed in the dual-head flow distribution assembly; moreover, the flow water inlet is connected with a water outlet of the micro-pump, the washing water outlet extends out of the housing, the drainage control water outlet is connected inside the drainage mechanism, and the drainage mechanism controls open or closing of a water outlet of the drainage base.

Furthermore, the dual-head flow distribution assembly may include a distribution body with a hollow cavity and a delay mechanism located inside the distribution body; additionally, the delay mechanism may include a water distribution piston and a delay spring. The water distribution piston may separate the hollow cavity of the distribution body into an upper cavity and a lower cavity, the delay spring may be located in the upper cavity, and a lower end of the delay spring may abut against the water distribution piston. In an initial state, either the washing water outlet or the drainage control water outlet may be communicated with the flow water inlet due to an obstruction of the water distribution piston; also, after a water pressure acts on the water distribution piston to compress the delay spring, the washing water outlet and the drainage control water outlet may be both communicated with the flow water inlet.

Preferably, a piston limiting boss may be arranged in the cavity of the distribution body and the water distribution piston may be limited above the piston limiting boss. The delay mechanism may further include an adjusting member, the adjusting member may be disposed on the distribution body movably up and down, the adjusting member may include a lower end located inside the distribution body and an upper end extending out of the distribution body, and an upper end of the delay spring may abut against the lower end of the adjusting member. The adjusting member may include an adjusting knob and an adjusting plate fixedly connected with the adjusting knob, the upper end of the delay spring may abut against the adjusting plate, a threaded hole may be formed in an upper part of the distribution body, an external thread may be formed in an outer wall of the adjusting knob, and the adjusting knob may be inserted into the threaded hole to be connected with the distribution body by screw transmission.

Preferably, a first pressure relief hole may be formed in an upper part of the distribution body and a second pressure relief hole may be formed in the water distribution piston.

Preferably, a water-passing cavity of the micro-pump may be arranged inside the micro-pump, an impeller of the micro-pump may be located in the water-passing cavity of the micro-pump, a third pressure relief hole may be formed in a side wall of the water-passing cavity of the micro-pump; moreover, the water inlet, the water outlet, and the third pressure relief hole of the micro-pump may be all communicated with the water-passing cavity of the micro pump.

The water outlet of the micro-pump may have a head of 4-12 m, and a flow rate of 15-25 L/min. The drainage control water outlet may have a head of 3-10 m, and a flow rate of 3-10 L/min. The washing water outlet may have a head of 3-5 m, and a flow rate of 12-18 L/min.

The drainage mechanism may include a valve body, a return spring, a piston, and water-sealing rubber. Also, the return spring may be arranged in an inner cavity of the valve body, the return spring may be located above the piston. Moreover, one end of the piston may be slidably arranged in the valve body, a drainage liquid cavity communicated with a water inlet of the valve body may be arranged below the piston, the other end of the piston may extend out of the valve body and may be connected with the water-sealing rubber, and the water-sealing rubber may be sealed and adapted with the water outlet of the drainage base. An installation plate may be connected below the water inlet in an outer wall of the valve body and the dual-head flow distribution assembly may be fixed on the installation plate to connect the drainage control water outlet to the water inlet of the valve body.

Due to the above structures, the present disclosure has the following beneficial effects:

1. According to the integrated water fitting assemblies, the water source is divided into two paths through the dual-outlet micro-pump or the dual-head flow distribution assembly to be respectively used for drainage and washing and two-path water source output can be realized with only one pump, which is simple in structure and low in cost. The drainage mechanism and the dual-outlet micro-pump are disposed in the housing (or the drainage mechanism, the micro-pump, and the dual-head flow distribution assembly are disposed in the housing) to form a whole, and only need to be disposed in a toilet water tank as a whole when in use, which occupies a small installation space and is convenient and quick in installation and after-sales services.

2. The pressure relief hole is formed above the washing water outlet and/or the drainage control water outlet, which can prevent "air trapping" caused by inability of discharging the air in the water-passing cavity, ensuring the normal operation of the impeller in the dual-outlet micro-pump and improving the reliability of the pump.
3. The impeller is arranged in a spiral type and the washing water outlet and the drainage control water outlet are inclined outward in the water flow conveying direction of the impeller. The washing water outlet and the drainage control water outlet are eccentrically formed on a side wall. A centrifugal force generated when the impeller rotates can throw the water source to the side wall and flow into the washing water outlet and the drainage control water outlet more excellently and faster, so as to improve the conveying efficiency.
4. By arranging the flushing aid tube for flushing, the integrated water fitting assembly is suitable for the toilet with the sunken water tank, which can improve the jet force during flushing thereby effectively improve the flushing and sewage disposal capacity of the toilet.
5. The filter screen is arranged at the water inlet of the dual-outlet micro-pump, through which the sundries in the water tank can be prevented from entering the water inlet of the washing pump to avoid malfunction.
6. The drainage base of the present disclosure is integrated with the water supplement tube, which is connected with an inlet valve of the smart toilet, such that the water supplement function of the toilet can be realized. The drainage base of the present disclosure is integrated with the water leakage tube, which is connected with the cover plate of the smart toilet, such that the water on the cover plate of the toilet can be collected and discharged.
7. In the present disclosure, the delay mechanism is arranged in the dual-head flow distribution assembly, such that the water source flows out from one water outlet first, and then water flows out from the other water outlet after a certain period of time, so as to wash the toilet before draining, or drain first and then wash the toilet.

REFERENCE NUMERALS

1: a housing, 11: an upper housing, 111: a through hole, 12: a lower housing, 13: a filter screen, 14: a snapping member, 141: a pressing part, 142: a snap, 2: a drainage mechanism, 21: a valve body, 22: a return spring, 23: a piston, 231: a drainage liquid cavity, 24: water-sealing rubber, 25: an installation plate, 3: a dual-outlet micro-pump, 31: a water-passing cavity, 32: a rotor shaft, 33: an impeller, 34: a water inlet, 35: a washing water outlet, 36: a drainage control water outlet, 37: a pressure relief hole, 4: a drainage base, 41: a water supplement tube, 42: a water leakage tube, 43: a flange, 5: a flushing aid pump, 51: a filter screen, 6: a flushing aid tube, 7: a flushing aid tubing, 71: an anti-siphon hole, 81: a water supply tube, 82: a solenoid valve, 9: an inlet valve, 10: a washing tubing, 200: a dual-head flow distribution assembly, 210: a flow water inlet, 220: a washing water outlet, 230: a drainage control water outlet, 240: a distribution body, 241: a piston limiting boss, 250: a first pressure relief hole, 260: a second pressure relief hole, 300: a micro-pump, 310: a third pressure relief hole, 400: a delay mechanism, 410: a water distribution piston, 420: a delay spring, 430: an adjusting knob, and 440: an adjusting plate.

DETAILED DESCRIPTION OF THE EMBODIMENTS

To enable those skilled in the art to better understand the technical solutions of the present disclosure, the present disclosure will be further described in detail below with reference to the accompanying drawings and specific embodiments.

Embodiment I

Figure 1:
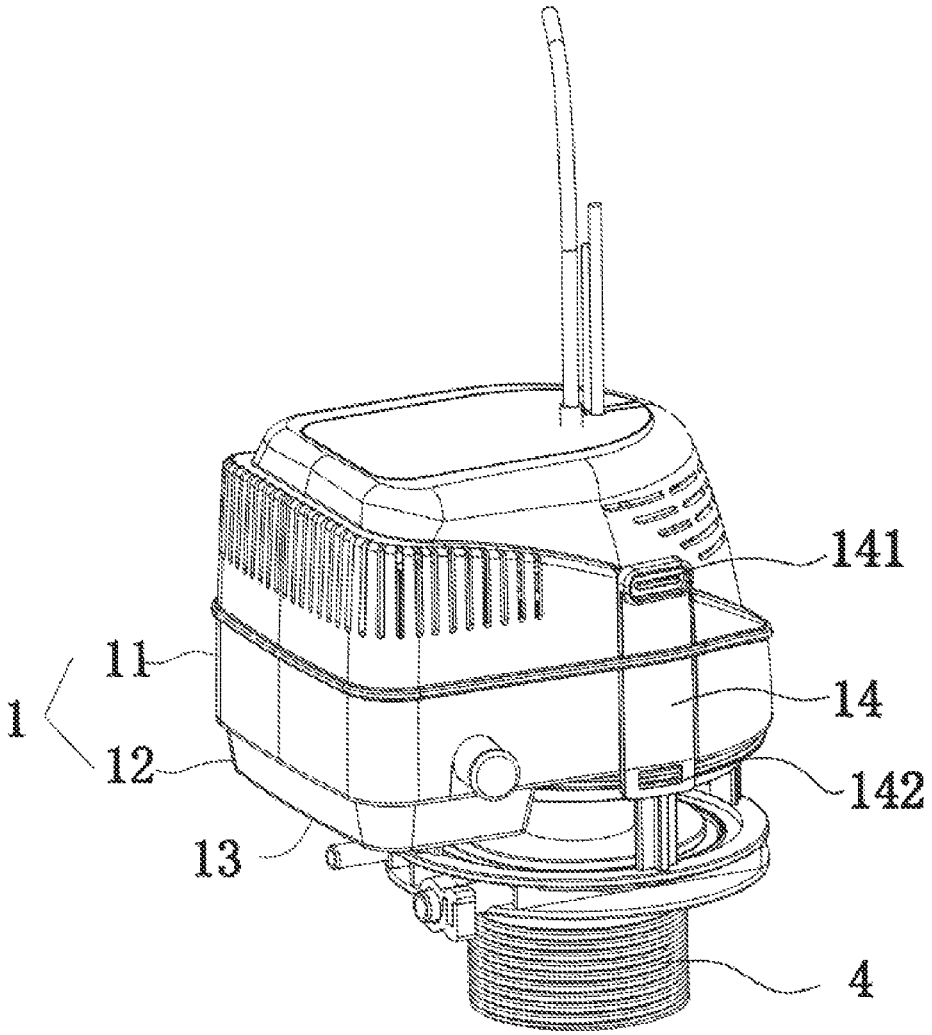
FIG. 1 is a schematic structural diagram of the present disclosure.
Figure 2:
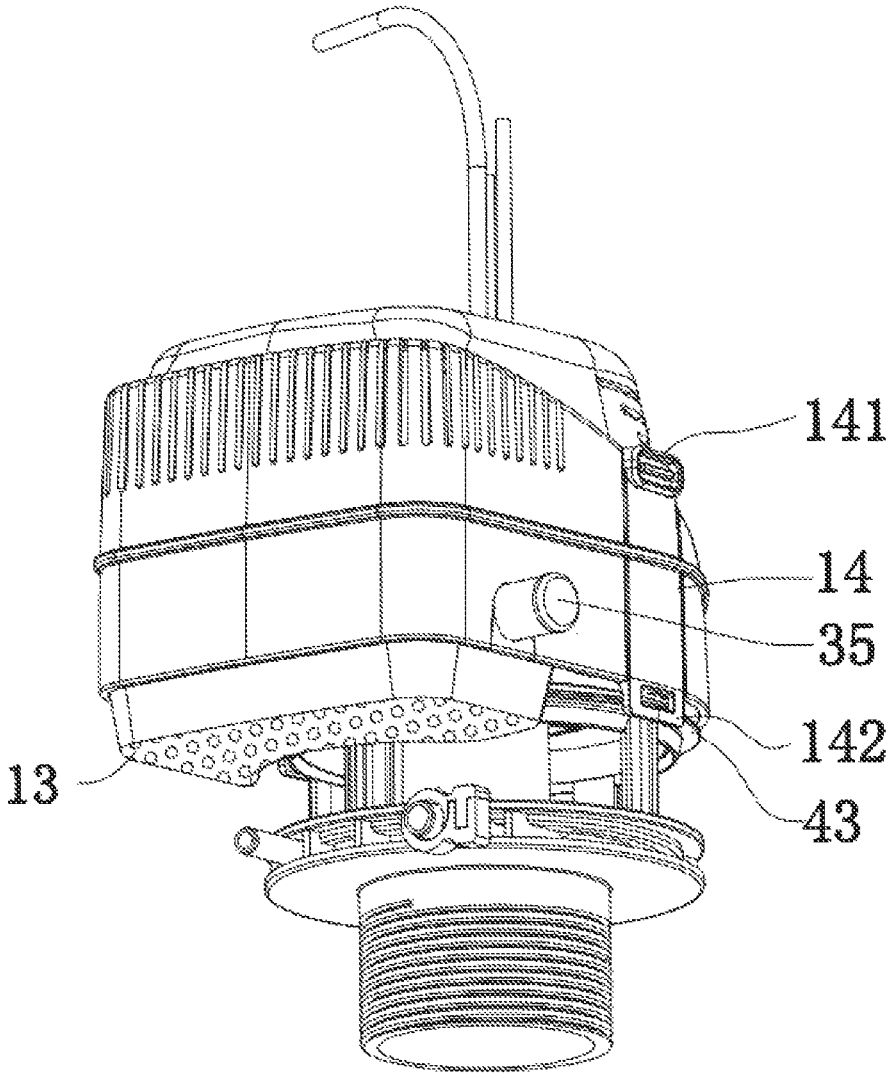
FIG. 2 is a schematic structural diagram of FIG. 1 from another angle.
Figure 3:
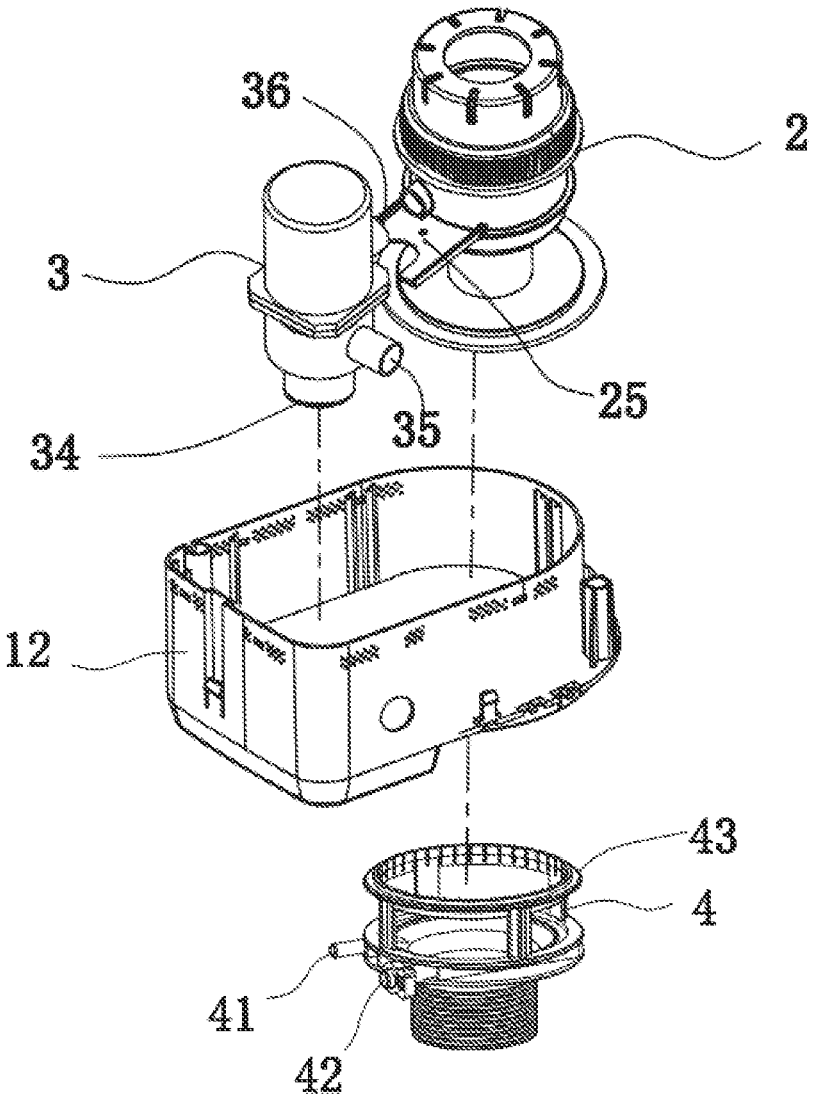
FIG. 3 is an exploded schematic diagram of Embodiment I (an upper housing is not shown in the figure)

As shown in FIG. 1 to FIG. 3, the present embodiment provides an integrated water fitting assembly with a dual-outlet micro-pump, including a housing 1, a drainage mechanism 2, a dual-outlet micro-pump 3, and a drainage base 4. When in use, the integrated water fitting assembly is disposed in a water tank of a toilet or a sunken water cavity.

The drainage mechanism 2 and the dual-outlet micro-pump 3 are disposed in the housing 1, the drainage base 4 is disposed below the housing 1, and the drainage mechanism 2 controls open or closing of a water outlet of the drainage base 4.

Figure 4:
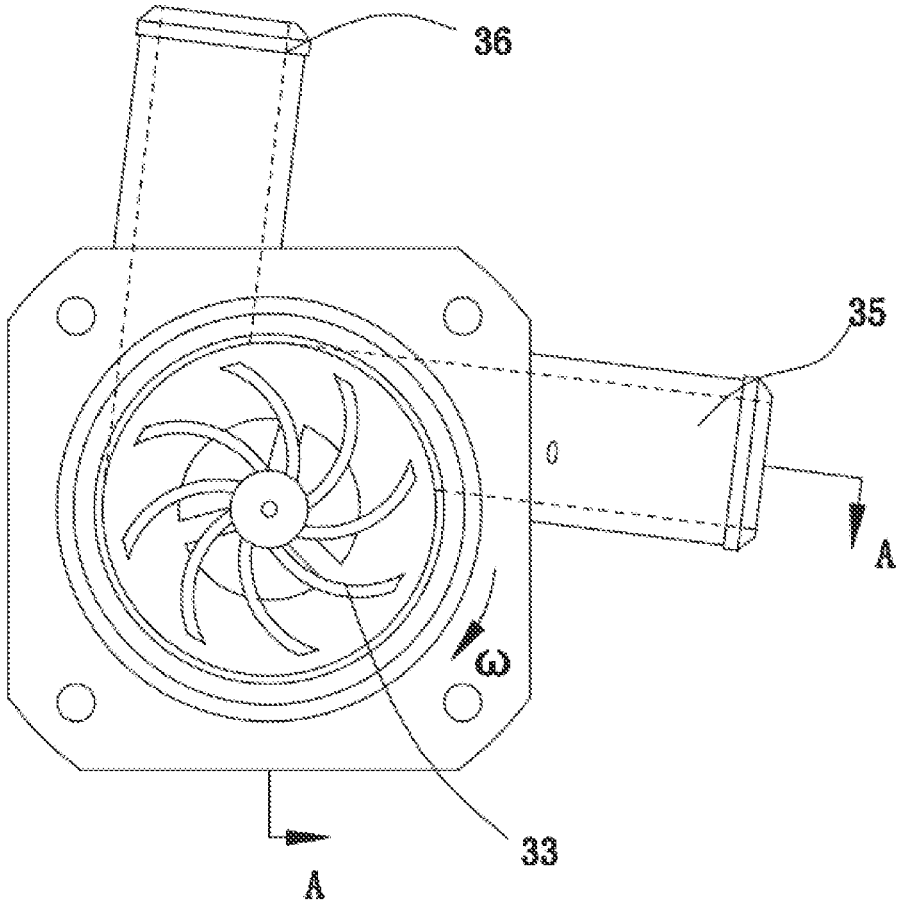
FIG. 4 is a schematic diagram of a dual-outlet micro-pump.
Figure 5:
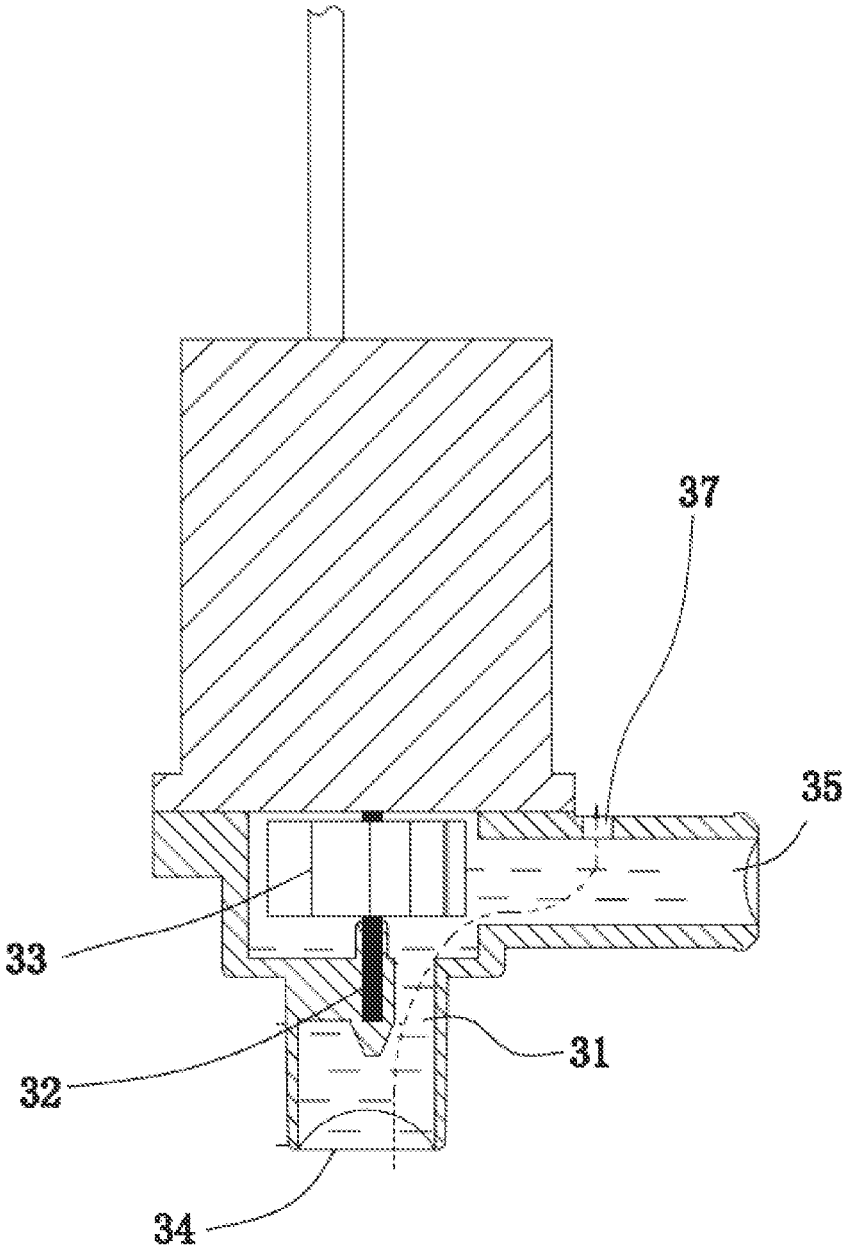
FIG. 5 is a schematic cross-sectional view of the dual-outlet micro-pump.

As shown in FIG. 4 and FIG. 5, the dual-outlet micro-pump 3 includes a water-passing cavity 31, a rotatable rotor shaft 32 is arranged in the water-passing cavity 31, and an impeller 33 is disposed on the rotor shaft 32. The water inlet 34, the washing water outlet 35, and the drainage control water outlet 36 are all communicated with the water-passing cavity 31. The water inlet 34 is formed at a bottom of the dual-outlet micro-pump 3, and the water inlet 34 is communicated with a water source. The washing water outlet 35 and the drainage control water outlet 36 are eccentrically formed on a side wall, the washing water outlet 35 extends out of the housing 1, and the drainage control water outlet 36 is connected inside the drainage mechanism 2. The impeller 33 is of a spiral type, and the washing water outlet 35 and the drainage control water outlet 36 are inclined outward. The direction of an arrow in FIG. 4, the direction of w, is the direction of rotation of the impeller (namely, the water flow conveying direction), such that the outward inclination direction of the washing water outlet 35 and the drainage control water outlet 36 follows the water flow conveying direction of the impeller to improve the water flow conveying efficiency.

As shown in FIG. 5, a pressure relief hole 37 is formed above the washing water outlet 35 or the drainage control water outlet 36 of the dual-outlet micro-pump 3, such that the water-passing cavity 31 of the dual-outlet micro-pump 3 and water in the water tank of the smart toilet form a communicating vessel to prevent the impeller 33 from idling due to air trapping in the water-passing cavity 31, resulting in the failure of the dual-outlet micro-pump 3.

By reasonably setting a volume flow rate of the water-passing cavity 31 of the dual-outlet micro-pump 3, a diameter of the water inlet 34, a diameter of the washing water outlet 35, and a diameter of the drainage control water outlet 36, the drainage control water outlet of the dual-outlet micro-pump can have a head of 3-10 m, and a flow rate of 3-10 L/min, and the washing water outlet can have a head of 3-5 m, and a flow rate of 12-18 L/min, so as to satisfy the needs for washing and drainage of the smart toilet.

Figure 6:
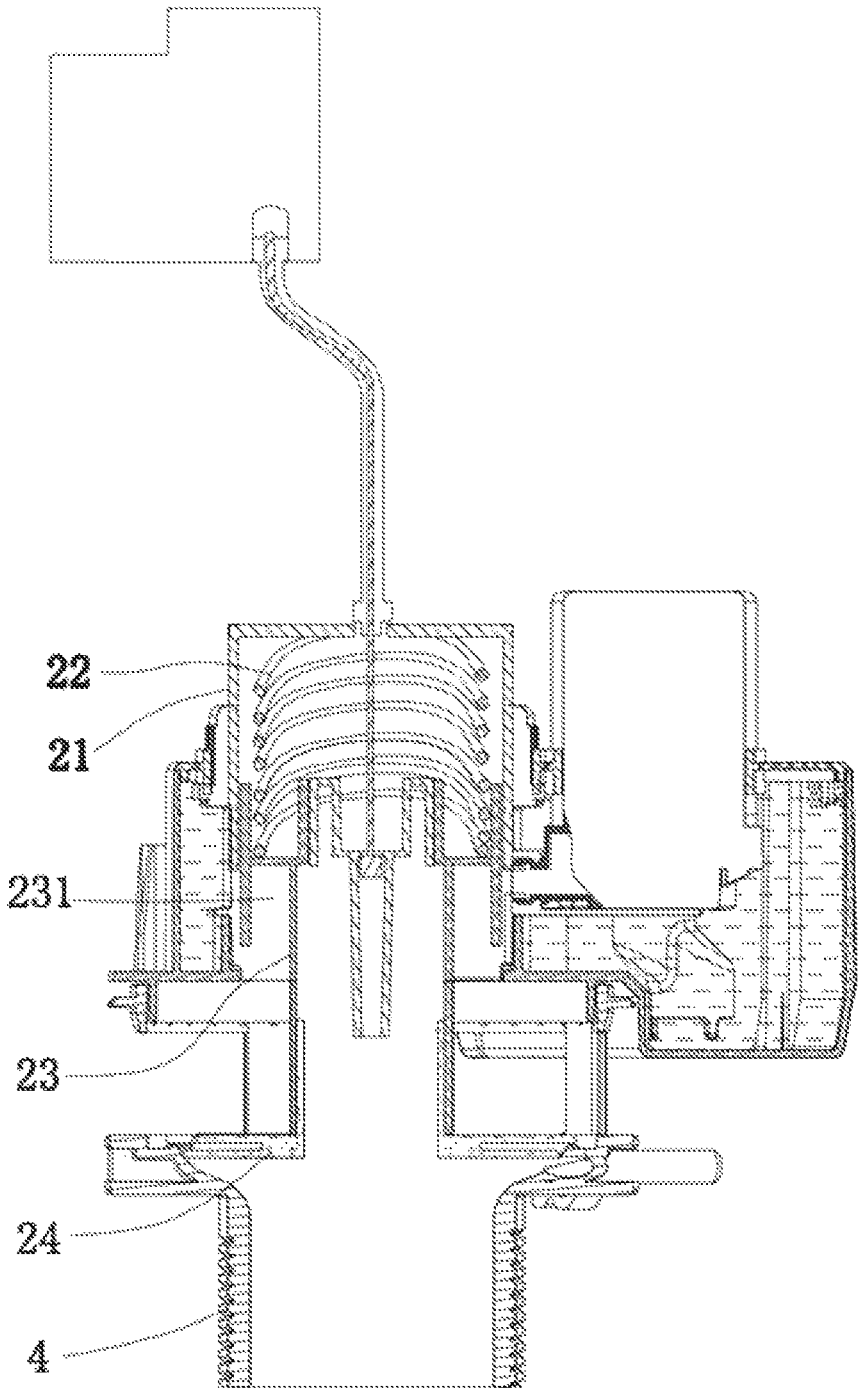
FIG. 6 is a schematic cross-sectional view of a drainage mechanism during closing.

As shown in FIG. 6, the drainage mechanism 2 includes a valve body 21, a return spring 22, a piston 23, and water-sealing rubber 24. An installation plate 25 is connected below the water inlet in an outer wall of the valve body 21, and the dual-outlet micro-pump 3 is fixed on the installation plate 25 to connect the drainage control water outlet 36 to the water inlet of the valve body 21. The piston 23 divide the valve body 21 into an upper cavity and a lower cavity, the lower cavity is a drainage liquid cavity 231 communicated with a water inlet of the valve body 21, and the return spring 22 is disposed in the upper cavity. The piston 23 is slidably arranged in the valve body 21, and a lower end of the piston 23 extends out of the valve body 21 and is connected with the water-sealing rubber 24. The water-sealing rubber 24 is sealed and adapted with the water outlet of the drainage base 4. When the piston 23 moves downward, the water-sealing rubber 24 seals the drainage base 4, and when the piston 23 moves upward, the water-sealing rubber 24 is opened to realize drainage. According to needs, a water supplement tube 41 or a water leakage tube 42 is further arranged at the water outlet of the drainage base 4. In the present embodiment, the water supplement tube 41 and the water leakage tube 42 are connected at the same time, as shown in FIG. 3. When in use, the water supplement tube 41 is connected with the inlet valve 9 of the smart toilet, such that the water supplement function of the toilet can be realized. The water leakage tube 42 is connected with the cover plate of the smart toilet, such that the water on the cover plate of the toilet can be collected and discharged.

In the present embodiment, the housing 1 includes an upper housing 11 and a lower housing 12 clamped with the upper housing 11. The dual-outlet micro-pump 3 and the valve body 21 are disposed on the lower housing 12, and a filter screen 13 is arranged at a position of the water inlet 34 of the dual-outlet micro-pump 3, as shown in FIG. 2.

Snapping members 14 are arranged on two sides of an outer wall of the upper housing 11 and each of the snapping members 14 includes a middle part fixedly connected to the upper housing 11 and two ends being cantilevers. Each of the snapping members 14 includes an upper end being a pressing part 141 for pressing by hand. Each of the snapping members 14 includes a lower end provided with a snap 142. A flange 43 is formed in the periphery of the drainage base 4, and the snap 142 is clamped on the flange 43, so as to connect the drainage base 4 with the upper housing 11.

When disassembly is required, the pressing parts 141 of two snapping members 14 are pressed by hand at the same time, the upper ends of the snapping members 14 are pressed inward, and the lower ends are tilted outward, such that the snaps 142 at the lower ends are disengaged from the flange 43. The upper housing 11 is slightly broken upward, so as to realize the disassembly of the upper housing 11 and the lower housing 12.

Figure 7:
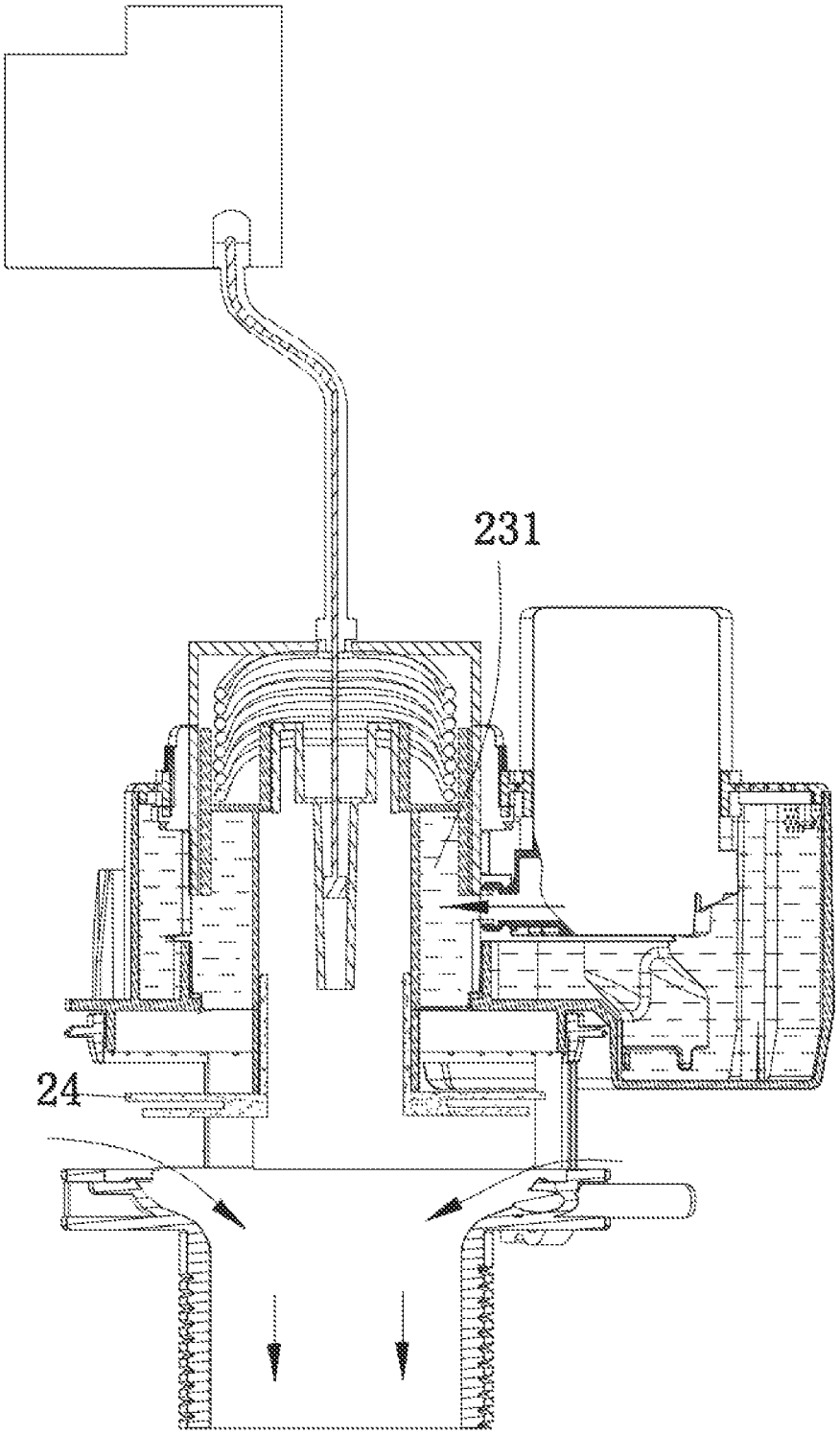
FIG. 7 is a schematic diagram showing a state in which the drainage mechanism is opened for drainage.
Figure 8:
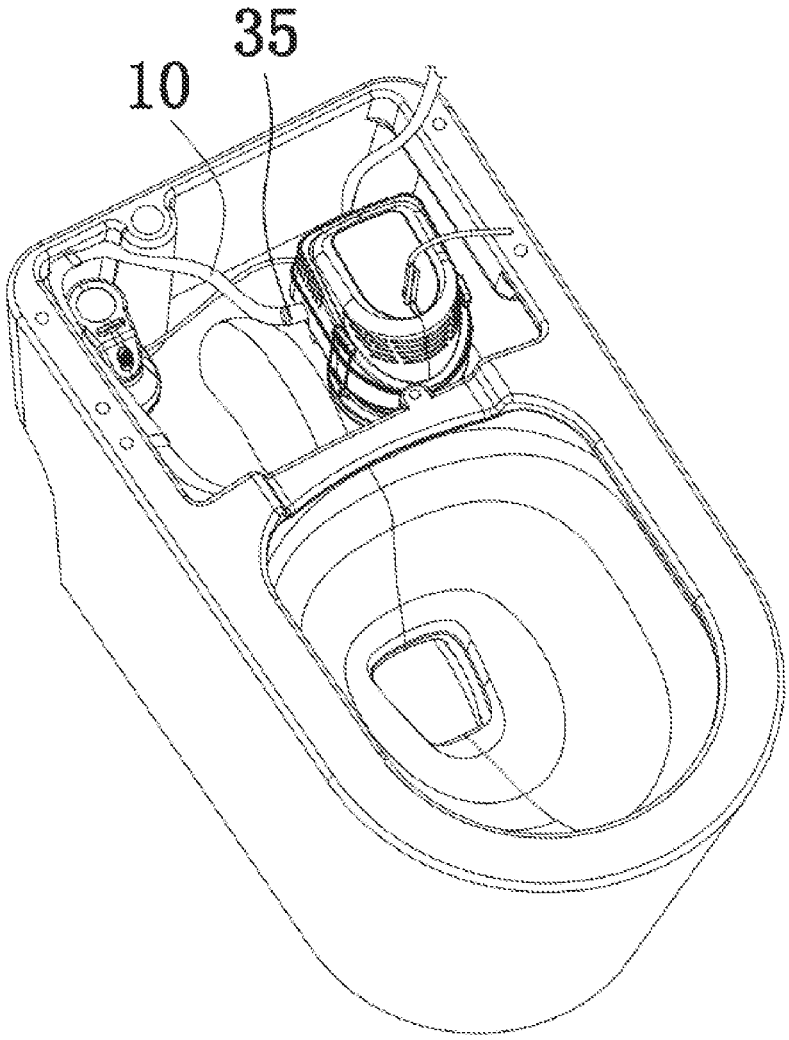
FIG. 8 is a schematic diagram of the present disclosure being disposed on a smart toilet.

The integrated drainage member of the present disclosure is in a dual control mode: as shown in FIG. 6, when the valve body 21 is in a closed state, the water-sealing rubber 24 seals the water outlet of the drainage base 4. When a mechanical control method is used, it is only necessary to pull the wire-controlled pull rope to drive the piston 23 to move upward, such that the water-sealing rubber 24 is separated from the drainage base 4, then the water outlet of the drainage base 4 is opened, and the water in the water tank is flushed from the water outlet of the drainage base 4 into the toilet. When an electronic control method is used, the dual-outlet micro-pump 3 is started, part of the water in the water tank is pumped from the water inlet 34 of the dual-outlet micro-pump 3 through the filter screen 13, and enters the drainage liquid cavity 231 from the drainage control water outlet 36, and the other part of the water enters the washing tubing 10 of the toilet from the washing water outlet 35. As shown in FIG. 7, since the water enters the drainage liquid cavity 231, the entire piston 23 slides upward under the action of the water pressure inside the valve body 21, and the return spring 22 is compressed at the same time, thereby opening the water outlet of the drainage base 4, and the water source in the water tank flows from the drainage base 4 into the toilet. As shown in FIG. 8, the water from the washing water outlet 35 flows into the wall surface of the toilet cavity of the toilet through the washing tubing 10 to wash the toilet cavity.

Embodiment II

Figure 9:
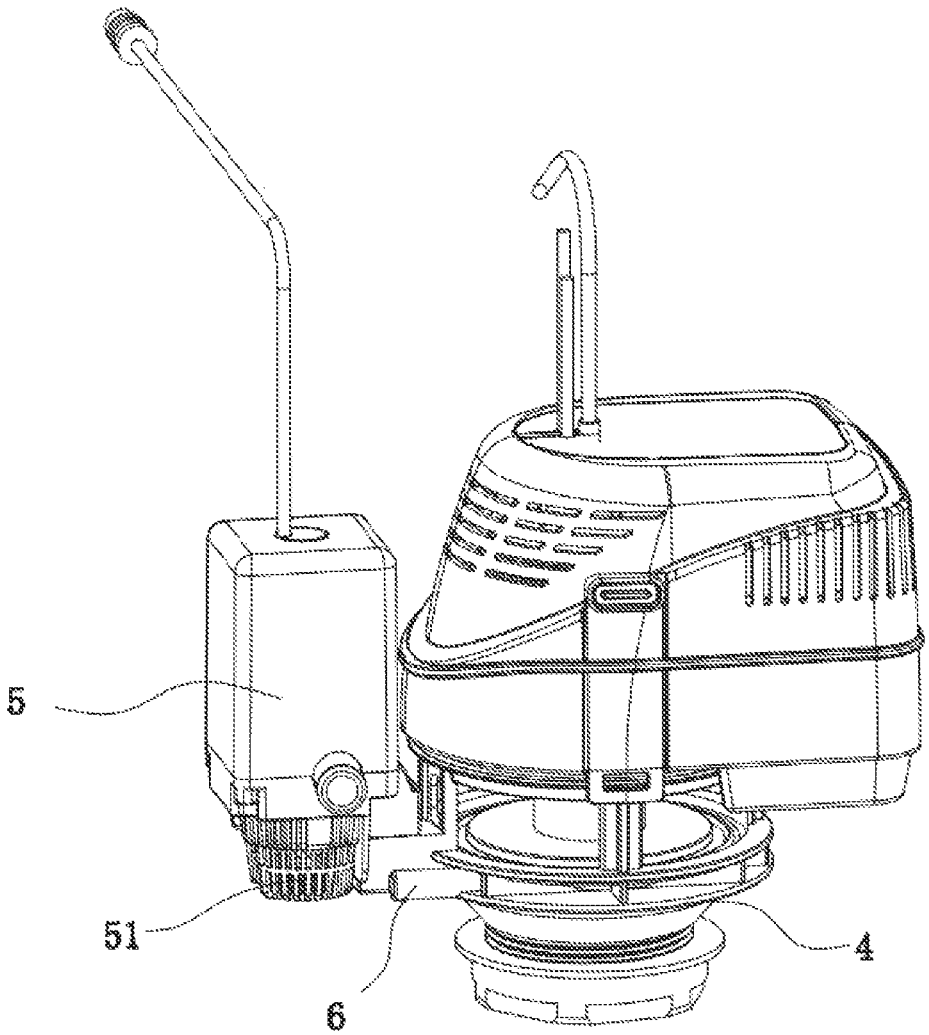
FIG. 9 is a schematic structural diagram of Embodiment II.

The present embodiment provides an integrated water fitting assembly with a dual-outlet micro-pump, which has the functions of drainage, washing, and flushing. As shown in FIG. 9, the present embodiment adds a flushing aid pump 5 and a flushing aid tube 6 on the basis of Embodiment I. The flushing aid pump 5 and the flushing aid tube 6 are connected through a flushing aid tubing 7. The flushing aid tube 6 includes an inlet end connected with a pressurized water source end, and an outlet end inserted into the drainage base 4 and connected with the water outlet of the drainage base 4.

As shown in FIG. 9, the flushing aid pump 5 is disposed on a side of the drainage base 4, and an installation bracket is arranged on the drainage base 4 for installing the flushing aid pump 5. A filter screen 51 may be arranged at a position of the water inlet of the flushing aid pump 5. In other embodiments, the flushing aid pump 5 may also be integrated in the housing 1, and the water outlet of the flushing aid pump 5 extends out of the housing 1.

Figure 10:
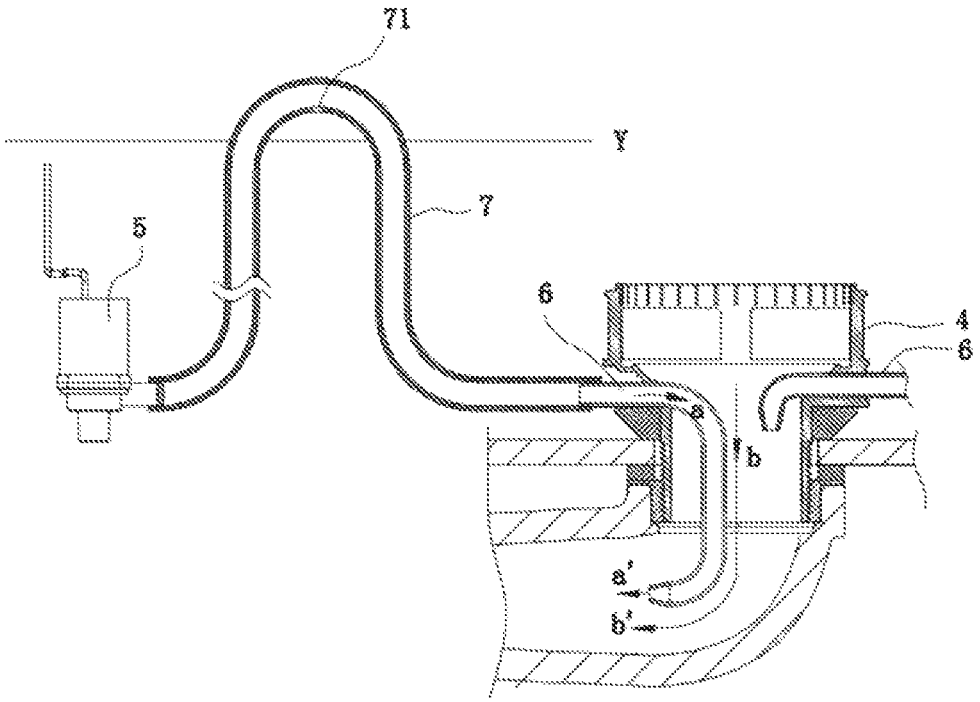
FIG. 10 is a schematic diagram of a flushing aid principle in Embodiment II.

As shown in FIG. 10, a water-passing cavity is arranged inside the flushing aid pump 5, an impeller of the flushing aid pump 5 is located in the water-passing cavity, and a water inlet and a water outlet of the flushing aid pump 5 are both communicated with the water-passing cavity of the flushing aid pump.

As shown in FIG. 10, the flushing aid tubing 7 is set in a U-shape, and the flushing aid tubing 7 includes one end connected with the flushing aid pump 5, and the other end connected with the flushing aid tube 6. In the present embodiment, a venturi tube is selected as the flushing aid tube 6, and the venturi tube has a gradually reduced diameter at the outlet end, which can better increase the flow rate of fluid and achieve a better flushing aid effect. Several venturi tubes can be provided (two venturi tubes are provided in FIG. 10). If more than one venturi tubes are provided, several branch tubes can be connected at the end of the flushing aid tubing 7 through an adapter, and each branch tube can be connected with the venturi tube respectively. The venturi tube can be integrally formed or assembled from several sections of tube body. In the form of assembly, the venturi tube can be assembled with structures of different materials according to needs, and can also be arranged in different directions according to different needs. The venturi tube can be made into U-shaped or L-shaped according to the needs, such that the water flow at the outlet end of the venturi tube is sprayed in different directions.

An anti-siphon hole 71 is formed in an upper part of the flushing aid tubing 7, and the anti-siphon hole 71 is higher than a working water level set in the water cavity, which can prevent siphoning.

When the smart toilet starts flushing, a main control unit independently drives the flushing aid pump 5 to work according to the needs. The flushing aid pump 5 pumps the water in the water cavity of the toilet into the flushing aid tube 6, the flow rate of the flushing aid water at the inlet end of the flushing aid tube 6 is a, and water is sprayed out from the outlet end of the flushing aid tube 6 through a small cross-sectional tube diameter. The flow rate of the flushing water is increased to a'. Due to the increased flow rate at the outlet end, the flow rate of the water discharged from the drainage base 4 is also increased, such that the flow rate of the water is increased from b to b', thereby effectively improving the ability of flushing the toilet cavity.

Embodiment III

Figure 11:
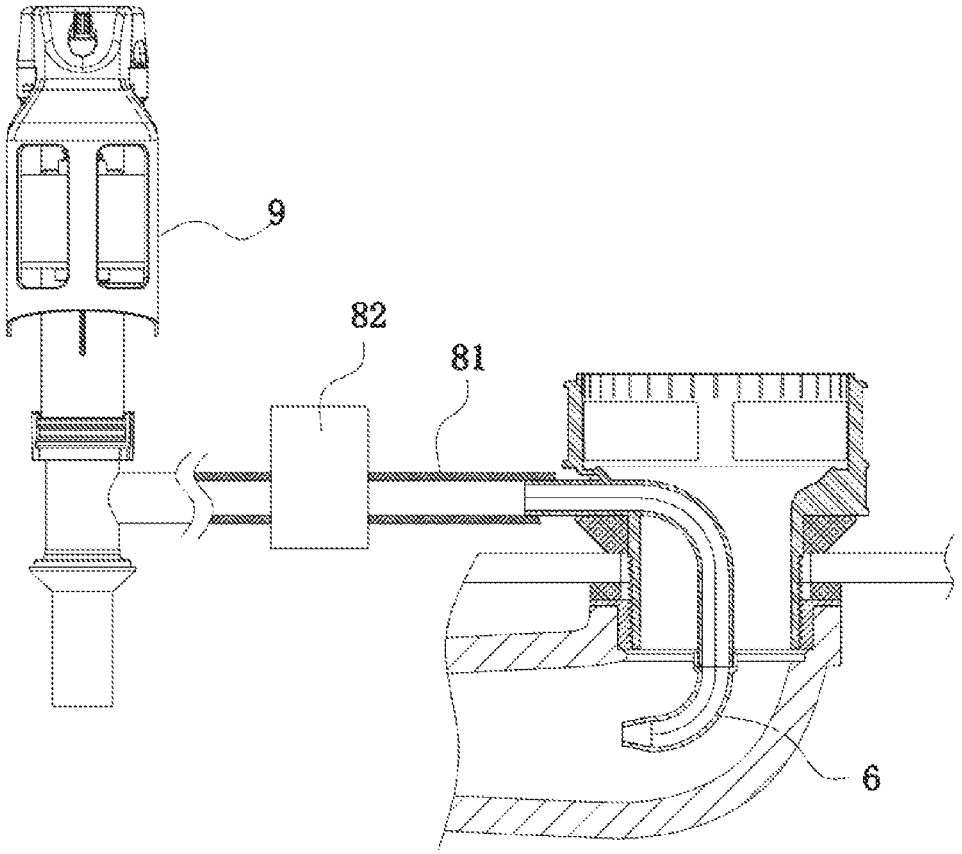
FIG. 11 is a schematic diagram of a flushing aid principle in Embodiment III.

As shown in FIG. 11, the present embodiment provides an integrated water fitting assembly with a dual-outlet micro-pump, which has the functions of drainage, washing, and flushing. The present embodiment adds a flushing aid tube on the basis of Embodiment I. An inlet end of the flushing aid tube 6 is connected with the inlet valve 9 of the toilet through a water supply tube 81, and a solenoid valve 82 for controlling on-off of the water flow in the water supply tube 81 is arranged on the water supply tube 81.

When the smart toilet starts flushing, a main control unit independently drives the solenoid valve 82 to work according to the needs, the water in the inlet valve 9 enters the flushing aid tube 6 through the water supply tube 81, and the diameter of the outlet end of the flushing aid tube 6 is gradually reduced. Since the diameter is reduced, the flow rate of the fluid is increased when the restricted flow passes through the reduced flow cross-section. The flushing aid water flow of the flushing aid tube 6 is ejected from a nozzle to increase the flow rate of the water in the drainage base 4, which further drives the flow rate of the water in the flushing tubing of the smart toilet, thereby increasing the jet force for flushing the toilet cavity.

Embodiment IV

Figure 12:
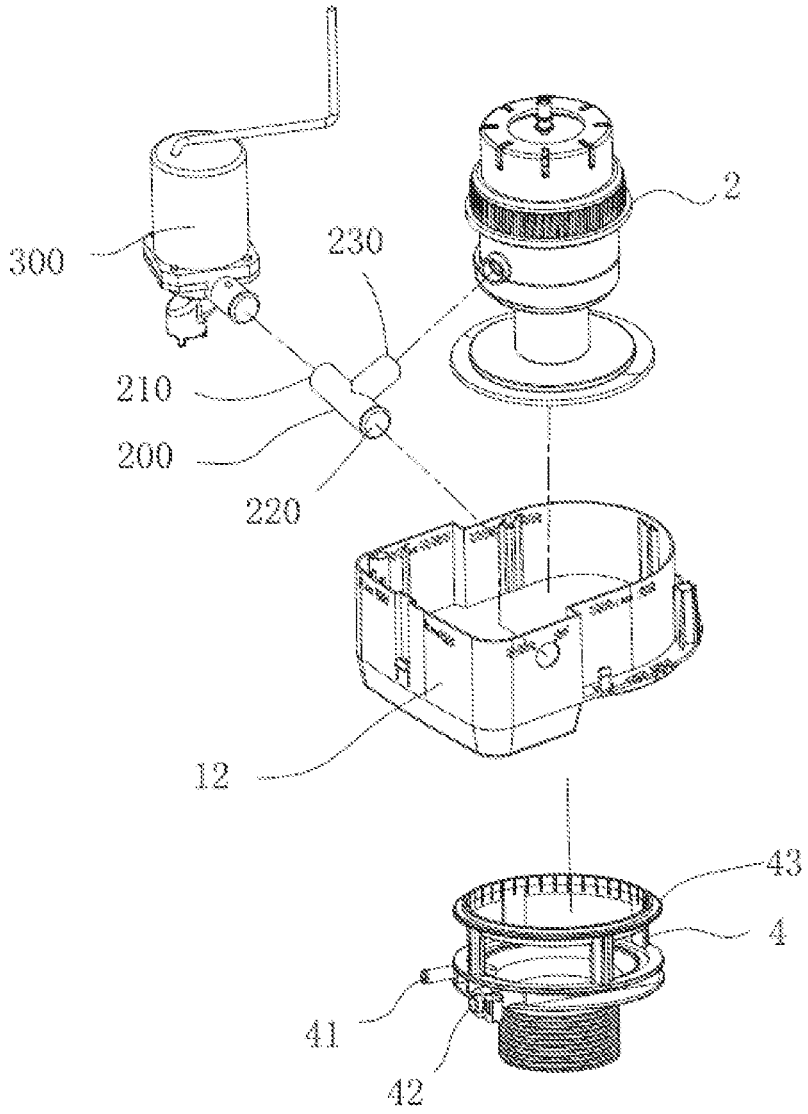
FIG. 12 is an exploded schematic diagram of Embodiment IV (an upper housing is not shown in the figure)
Figure 13:
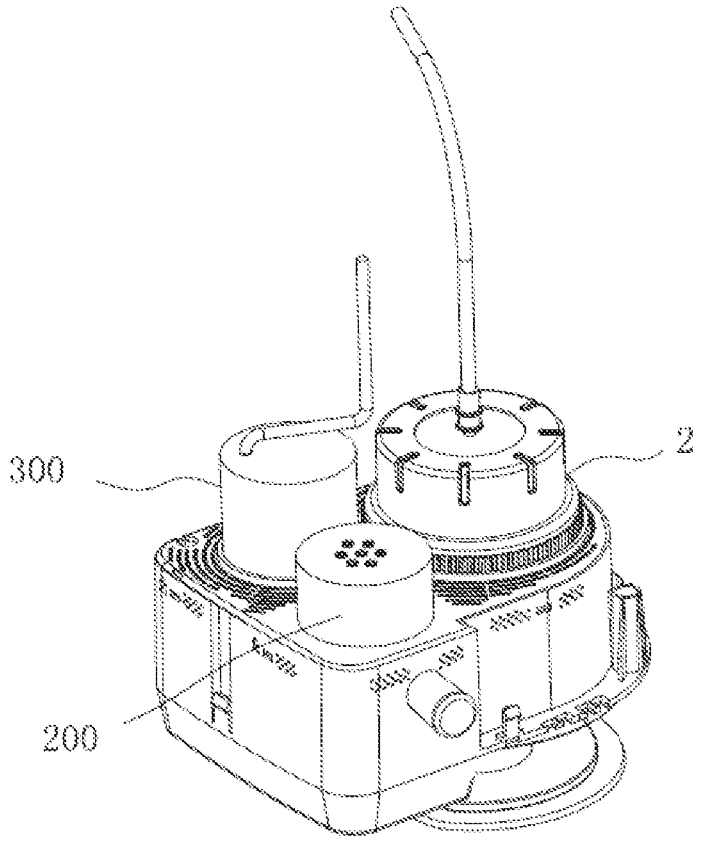
FIG. 13 is a schematic structural diagram of Embodiment V (an upper housing and a drainage base are not shown in the figure)
Figure 14:
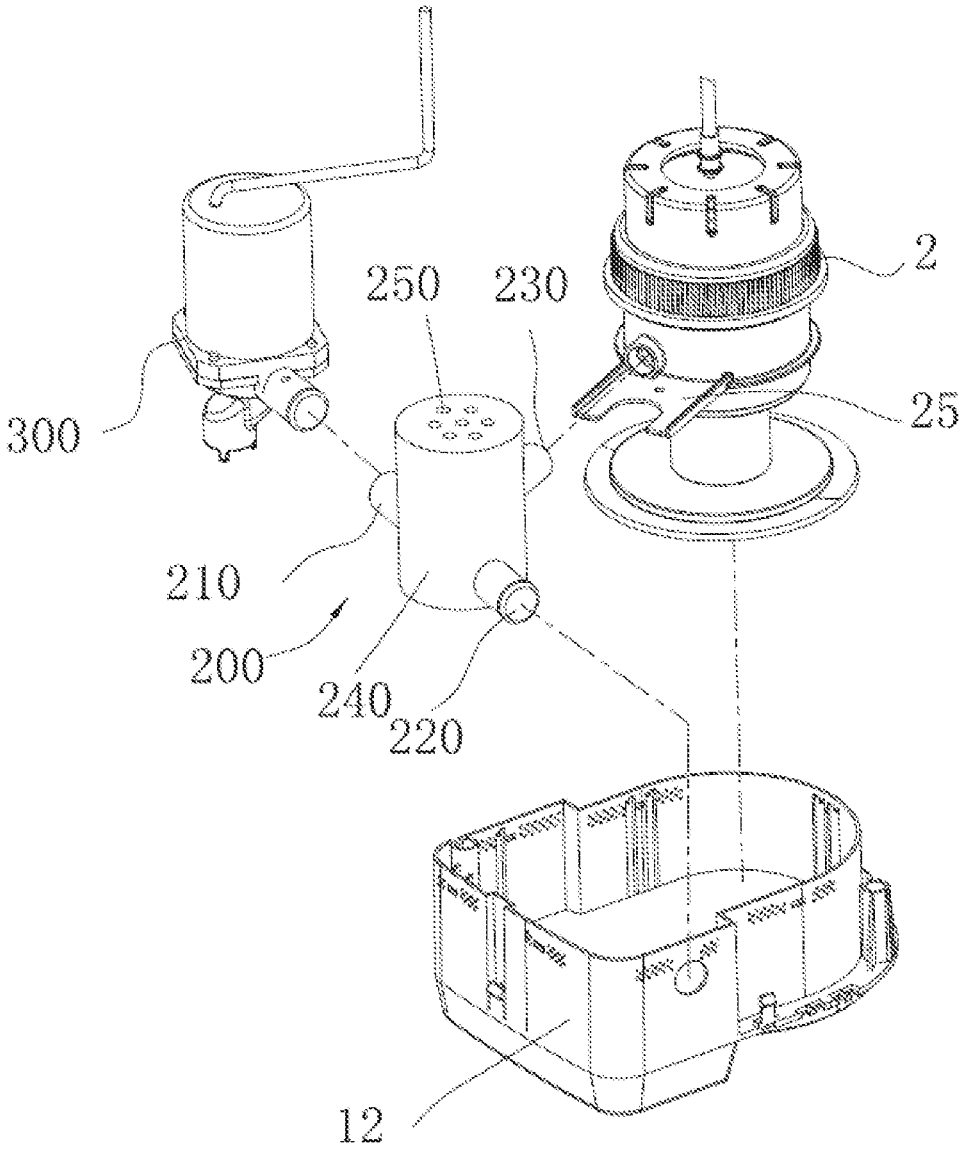
FIG. 14 is an exploded schematic diagram of FIG. 13.

As shown in FIG. 1 and FIG. 12, the present embodiment provides an integrated water fitting assembly, including: a housing 1, a drainage mechanism 2, a dual-head flow distribution assembly 200, a micro-pump 300, and a drainage base 4. When in use, the present disclosure is disposed in a water tank of a toilet or a sunken water cavity.

The dual-head flow distribution assembly 200 in the present embodiment uses the existing three-way valve, including a flow water inlet 210, a washing water outlet 220, and a drainage control water outlet 230 that are communicated with each other.

The drainage mechanism 2, the dual-head flow distribution assembly 200, and the micro-pump 300 are disposed in the housing 1, the drainage base 4 is disposed below the housing 1, and a water inlet of the micro-pump 300 is communicated with a water source. The flow water inlet 210 is connected with a water outlet of the micro-pump 300, the washing water outlet 220 extends out of the housing 1, and the drainage control water outlet 230 is connected inside the drainage mechanism 2.

As shown in FIG. 6, the drainage mechanism 2 includes a valve body 21, a return spring 22, a piston 23, and water-sealing rubber 24. The return spring 22 is arranged in an inner cavity of the valve body 21 and the return spring 22 is located above the piston 23. A drainage liquid cavity 231 communicated with a water inlet of the valve body is arranged below the piston 23, one end of the piston is slidably arranged in the valve body 21, and the other end of the piston extends out of the valve body 21 and is connected with the water-sealing rubber 24. The water-sealing rubber 24 is sealed and adapted with the water outlet of the drainage base 4. When the piston 23 moves downward, the water-sealing rubber 24 seals the drainage base 4, and when the piston 23 moves upward, the water-sealing rubber 24 is opened to realize drainage. According to needs, a water supplement tube 41 or a water leakage tube 42 is further arranged at the water outlet of the drainage base 4. In the present embodiment, the water supplement tube 41 and the water leakage tube 42 are connected at the same time, as shown in FIG. 12. The water supplement tube 41 is connected with the inlet valve 9 of the smart toilet, such that the water supplement function of the toilet can be realized. The water leakage tube 42 is connected with the cover plate of the smart toilet, such that the water on the cover plate of the toilet can be collected and discharged.

In the present embodiment, the housing includes an upper housing 11 and a lower housing 12. The micro-pump 300 and the valve body 21 are disposed on the lower housing 12, and a filter screen 13 is arranged at a position of the lower housing 12 corresponding to the water inlet of the micro-pump 300, as shown in FIG. 2.

Figure 15:
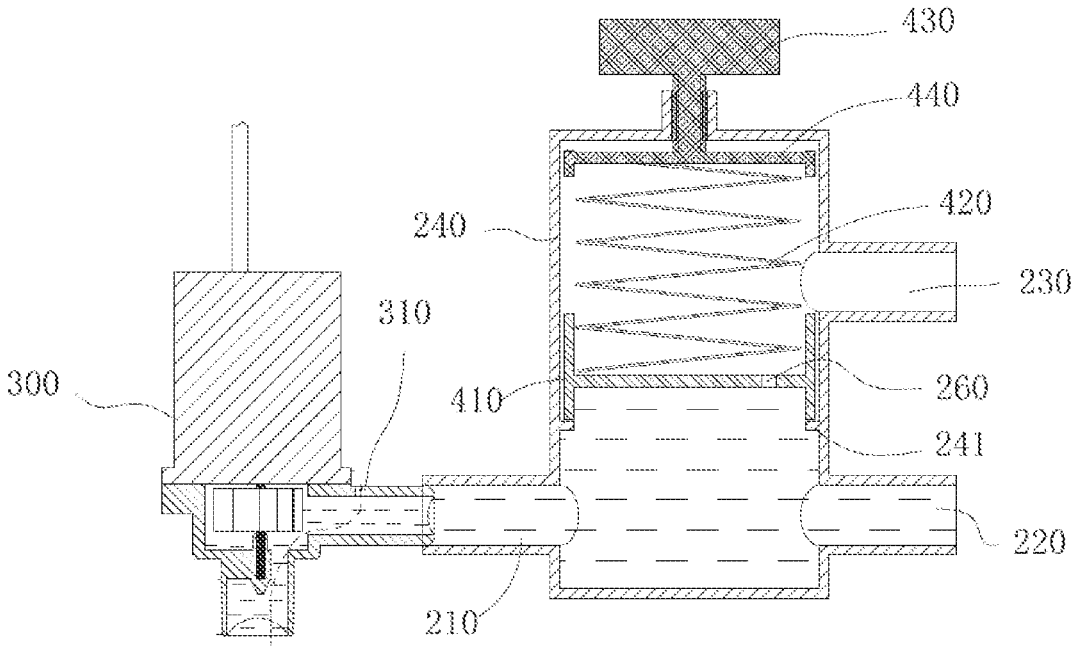
FIG. 15 is a schematic diagram of connection between a micro-pump and a dual-head distribution assembly in Embodiment V.

As shown in FIG. 15, a water-passing cavity of the micro-pump is arranged inside the micro-pump 300, an impeller of the micro-pump is located in the water-passing cavity of the micro-pump, a third pressure relief hole 310 is formed in a side wall of the water-passing cavity of the micro-pump, and the water inlet, the water outlet, and the third pressure relief hole 310 of the micro-pump 300 are all communicated with the water-passing cavity of the micro pump.

Snapping members 14 are arranged on two sides of an outer wall of the upper housing 11 and each of the snapping members 14 includes a middle part fixedly connected to the upper housing 11 and two ends being cantilevers. Each of the snapping members 14 includes an upper end being a pressing part 141 for pressing by hand. Each of the snapping members 14 includes a lower end provided with a snap 142. A flange 43 is formed in the periphery of the drainage base 4, and the snap 142 is clamped on the flange 43, so as to connect the drainage base 4 with the upper housing 11.

When disassembly is required, the pressing parts 141 of two snapping members 14 are pressed by hand at the same time, the upper ends of the snapping members 14 are pressed inward, and the lower ends are tilted outward, such that the snaps 142 at the lower ends are disengaged from the flange 43. The upper housing 11 is slightly broken upward, so as to realize the disassembly of the upper housing 11 and the lower housing 12.

The integrated drainage member of the present disclosure is in a dual control mode: as shown in FIG. 6, when the valve body 21 is in a closed state, the water-sealing rubber 24 seals the water outlet of the drainage base 4. When a mechanical control method is used, it is only necessary to pull the wire-controlled pull rope to drive the piston 23 to move upward, such that the water-sealing rubber 24 is separated from the drainage base 4. Then, the water outlet of the drainage base 4 is opened and the water in the water tank is flushed from the water outlet of the drainage base 4 into the toilet. When an electronic control method is used, the dual-outlet micro-pump 300 is started, part of the water in the water tank is pumped by the micro-pump 300, enters the drainage liquid cavity 231 from the drainage control water outlet 230, and the other part of the water enters the washing tubing 10 of the toilet from the washing water outlet 220. As shown in FIG. 7, since the water enters the drainage liquid cavity 231, the entire piston 23 slides upward under the action of the water pressure inside the valve body 21, and the return spring 22 is compressed at the same time, thereby opening the water outlet of the drainage base 4, and the water source in the water tank flows from the drainage base 4 into the toilet. As shown in FIG. 8, the water from the washing water outlet 220 flows into the wall surface of the toilet cavity of the toilet through the washing tubing 10 to wash the toilet cavity.

Embodiment V

As shown in FIG. 13 to FIG. 19, the present embodiment provides an integrated water fitting assembly. The difference between the present embodiment and Embodiment IV is: the dual-head flow distribution assembly 200 in the present embodiment includes a distribution body 240 with a hollow cavity and a delay mechanism 400 located inside the distribution body 240. An installation plate 25 is connected below the water inlet in an outer wall of the valve body 21 of the drainage mechanism 2 and the dual-head flow distribution assembly 200 is fixed on the installation plate 25 to connect the drainage control water outlet 230 to the water inlet of the valve body 21.

As shown in FIG. 15, the delay mechanism includes a water distribution piston 410, a delay spring 420, and an adjusting member. The adjusting member includes an adjusting knob 430 and an adjusting plate 440 fixedly connected with the adjusting knob. The adjusting plate 440 is located inside the distribution body 240, and the adjusting knob 430 extends out of the distribution body 240. The adjusting member is disposed on the distribution body 240 movably up and down. For example, in the present embodiment, screw transmission connection is used: a threaded hole is formed in an upper part of the distribution body 240, an external thread is formed in an outer wall of the adjusting knob 430, and the adjusting knob 430 is inserted into the threaded hole to be connected with the distribution body 240 by screw transmission. Other up and down movement methods can also be used, such as controlling the up and down movement of the adjusting plate through a motor push rod.

The water distribution piston 410 separates the hollow cavity of the distribution body 240 into an upper cavity and a lower cavity, the delay spring 420 is located in the upper cavity, an upper end of the delay spring 420 abuts against the adjusting plate 440, and a lower end of the delay spring 420 abuts against the water distribution piston 410. A piston limiting boss 241 is arranged in the cavity of the distribution body 240, and the water distribution piston 410 is limited above the piston limiting boss 241.

Figure 16:
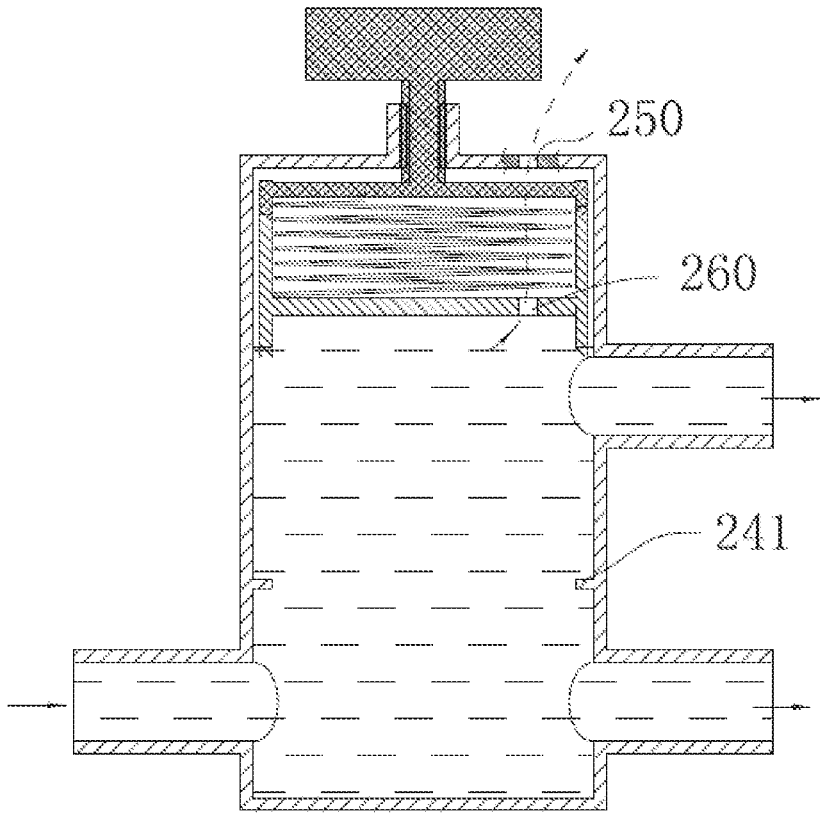
FIG. 16 is a schematic diagram showing a state when a water distribution piston compresses a delay spring in FIG. 15.
Figure 17:
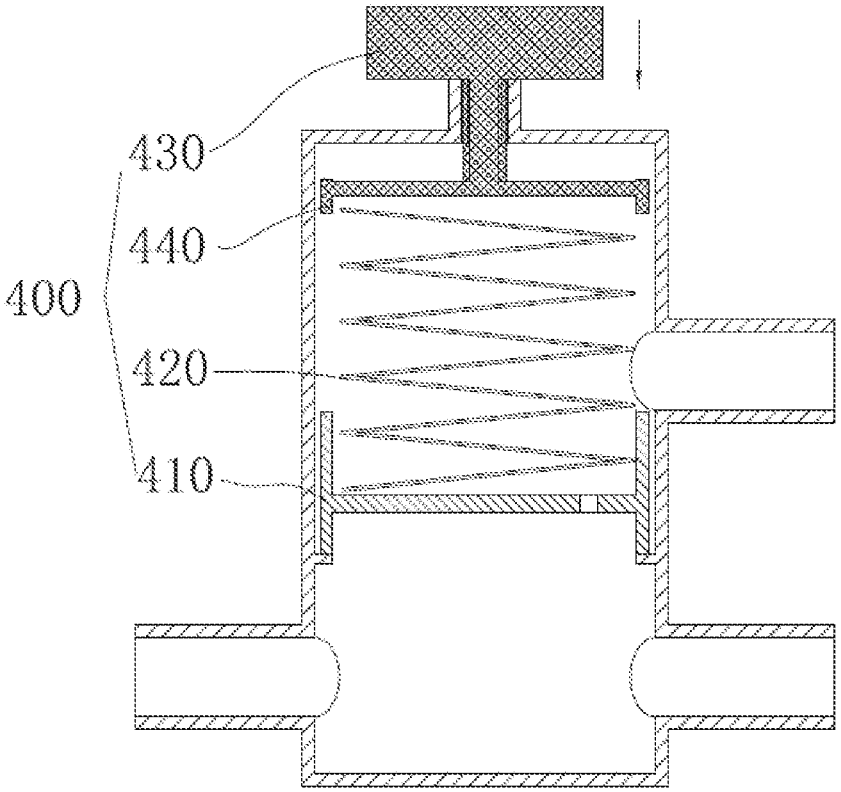
FIG. 17 is a schematic structural diagram of an adjusting knob.

As shown in FIG. 15, in an initial state of the delay spring 420, the water distribution piston 410 is located between the washing water outlet 220 and the drainage control water outlet 230. In the present embodiment, the washing water outlet 220 is located below the drainage control water outlet 230, and only the washing water outlet 220 is communicated with the flow water inlet 210. As shown in FIG. 16, after a water pressure acts on the water distribution piston 410 to compress the delay spring 420, the washing water outlet 220 and the drainage control water outlet 230 are both communicated with the flow water inlet 210. In the present embodiment, toilet washing is controlled first and then drainage is realized. By exchanging the positions of the washing water outlet 220 and the drainage control water outlet 230, the toilet drainage can also be controlled first, and then washing is realized. As shown in FIG. 17, by moving the adjusting knob 430 up and down, a compression length of the delay spring 420 can be adjusted, thereby adjusting the elastic force of the delay spring 420 to achieve different delay requirements.

Figure 18:
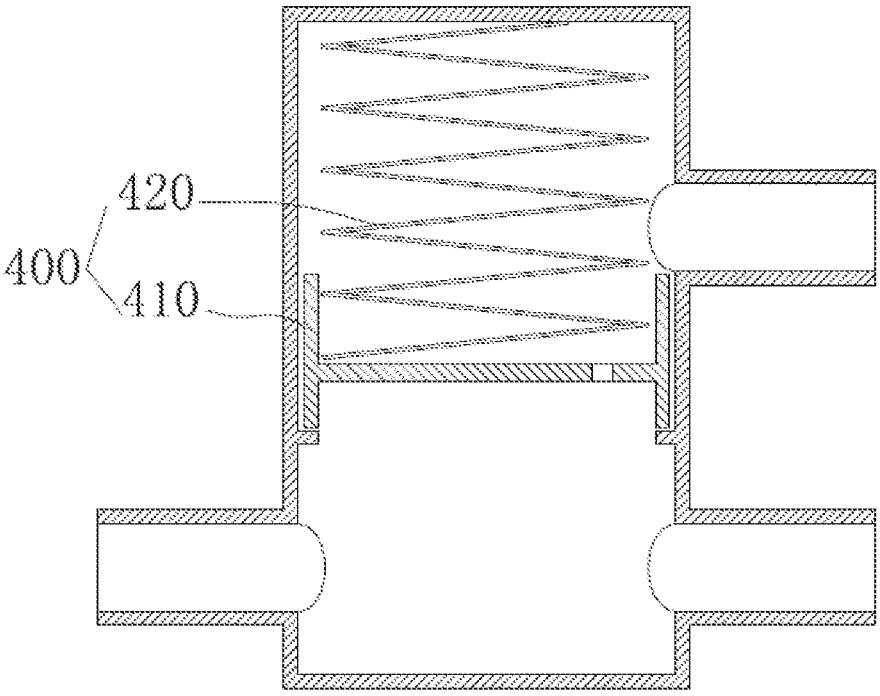
FIG. 18 is a schematic diagram of a dual-head distribution assembly without an adjusting member.
Figure 19:
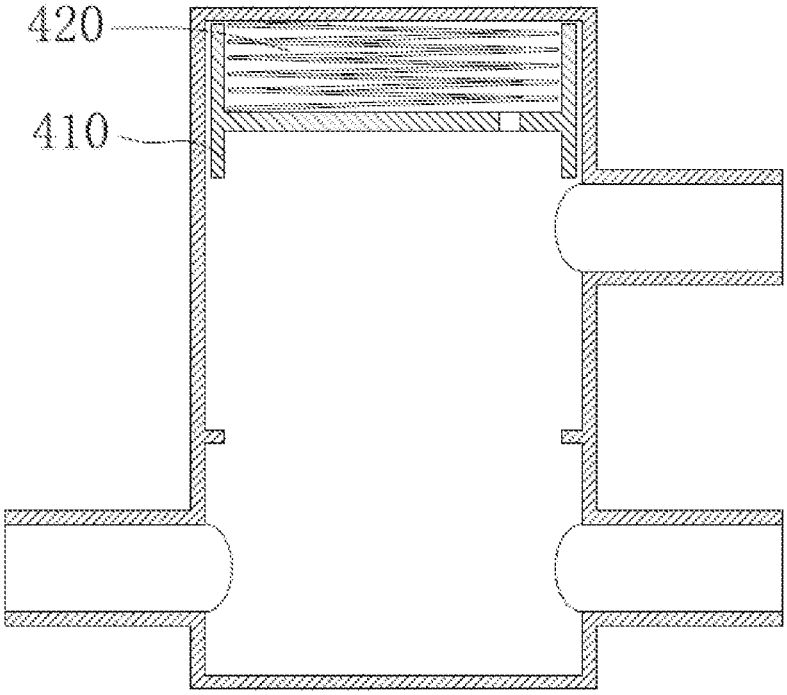
FIG. 19 is a schematic diagram showing a state when a water distribution piston compresses a delay spring in FIG. 18.

As shown in FIG. 18 and FIG. 19, in other implementations, the delay mechanism may only include the water distribution piston 410 and the delay spring 420. The upper end of the delay spring 420 abuts against the upper wall of the distribution body 240, and the lower end of the delay spring 420 abuts against the water distribution piston 410. By selecting a suitable delay spring, the demand for the delay of the upper outlet can be realized.

As shown in FIG. 16, in order to prevent "air trapping" caused by excessive air in the distribution body, a first pressure relief hole 250 is formed in an upper part of the distribution body 240, and a second pressure relief hole 260 is formed in the water distribution piston 410, such that the air is discharged to the outside of the distribution body in time.

By reasonably setting a volume flow rate of the inner cavity of the dual-head flow distribution assembly, a diameter of the water inlet, a diameter of the washing water outlet, and a diameter of the drainage control water outlet, the water outlet of the micro-pump can have a head of 4-12 m and a flow rate of 15-25 L/min, the drainage control water outlet can have a head of 3-10 m and a flow rate of 3-10 L/min, and the washing water outlet can have a head of 3-5 m and a flow rate of 12-18 L/min, so as to satisfy the needs for washing and drainage of the smart toilet.

Embodiment VI

The present embodiment provides an integrated water fitting assembly, which has the functions of drainage, washing, and flushing aid. The present embodiment adds a flushing aid pump 5 and a flushing aid tube 6 on the basis of Embodiment IV or Embodiment V. The connection and use principle of the flushing aid pump 5 and the flushing aid tube 6 are the same as those in Embodiment II.

Embodiment VII

As shown in FIG. 11, the present embodiment provides an integrated water fitting assembly, which has the functions of drainage, washing, and flushing aid. The present embodiment adds a flushing aid tube on the basis of Embodiment IV or Embodiment V. An inlet end of the flushing aid tube 6 is connected with the inlet valve 9 of the toilet through a water supply tube 81, and a solenoid valve 82 for controlling on-off of the water flow in the water supply tube 81 is arranged on the water supply tube 81. The use principle of the present embodiment is the same as those in Embodiment II.

The above described are merely preferred implementations of the present disclosure, and the protection scope of the present disclosure is not limited thereto. Any modification or replacement easily conceived by those skilled in the art within the technical scope of the present disclosure should fall within the protection scope of the present disclosure.

What is claimed is:

1. An integrated water fitting assembly, comprising: a housing, a drainage mechanism, a dual-outlet micro-pump, and a drainage base, wherein the drainage mechanism and the dual-outlet micro-pump are disposed in the housing, the drainage base is disposed below the housing, a first water inlet, a washing water outlet, and a drainage control water outlet are communicated with each other, the first water inlet, the washing water outlet, and the drainage control water outlet are formed in the dual-outlet micro-pump, the first water inlet is communicated with a water source, the washing water outlet extends out of the housing, the drainage control water outlet is connected inside the drainage mechanism, and the drainage mechanism controls an open or a closing of a water outlet of the drainage base; wherein the dual-outlet micro-pump comprises a water-passing cavity, a rotatable rotor shaft is arranged in the water-passing cavity, an impeller is disposed on the rotatable rotor shaft, the first water inlet, the washing water outlet, and the drainage control water outlet are all communicated with the water-passing cavity, the first water inlet is formed at a bottom of the dual-outlet micro-pump, and the washing water outlet and the drainage control water outlet are eccentrically formed on a side wall.

2. The integrated water fitting assembly according to claim 1, wherein a pressure relief hole is formed above the washing water outlet or the drainage control water outlet, the impeller is of a spiral type, and the washing water outlet and the drainage control water outlet are inclined outward in a water flow conveying direction of the impeller.

3. The integrated water fitting assembly according to claim 1, wherein the drainage control water outlet of the dual-outlet micro-pump has a head of 3-10 m and a flow rate of 3-10 L/min; and the washing water outlet of the dual-outlet micro-pump has a head of 3-5 m and a flow rate of 12-18 L/min.

4. The integrated water fitting assembly according to claim 1, wherein the drainage mechanism comprises a valve body, a return spring, a piston, and a water-sealing rubber, the piston is slidably arranged in the valve body to divide the valve body into an upper cavity and a lower cavity, the lower cavity is a drainage liquid cavity, the return spring is disposed in the upper cavity, a bottom of the piston extends out of the valve body and the bottom of the piston is connected with the water-sealing rubber, the water-sealing rubber is sealed and adapted with the water outlet of the drainage base, an installation plate is connected below the second water inlet in an outer wall of the valve body, and the dual-outlet micro-pump is fixed on the installation plate to connect the drainage control water outlet to the second water inlet of the valve body.

5. An integrated water fitting assembly comprising: a housing, a drainage mechanism, a dual-outlet micro-pump, and a drainage base, wherein the drainage mechanism and the dual-outlet micro-pump are disposed in the housing, the drainage base is disposed below the housing, a first water inlet, a washing water outlet, and a drainage control water outlet are communicated with each other, the first water inlet, the washing water outlet, and the drainage control water outlet are formed in the dual-outlet micro-pump, the first water inlet is communicated with a water source, the washing water outlet extends out of the housing, the drainage control water outlet is connected inside the drainage mechanism, and the drainage mechanism controls an open or a closing of a water outlet of the drainage base; wherein a water supplement tube and/or a water leakage tube is/are further arranged on the drainage base, the water supplement tube and the water leakage tube are communicated with the water outlet of the drainage base, and the washing water outlet is connected with a washing tubing.

6. An integrated water fitting assembly comprising: a housing, a drainage mechanism, a dual-outlet micro-pump, and a drainage base, wherein the drainage mechanism and the dual-outlet micro-pump are disposed in the housing, the drainage base is disposed below the housing, a first water inlet, a washing water outlet, and a drainage control water outlet are communicated with each other, the first water inlet, the washing water outlet, and the drainage control water outlet are formed in the dual-outlet micro-pump, the first water inlet is communicated with a water source, the washing water outlet extends out of the housing, the drainage control water outlet is connected inside the drainage mechanism, and the drainage mechanism controls an open or a closing of a water outlet of the drainage base; further comprising a plurality of flushing aid tubes, wherein each of the plurality of flushing aid tubes comprises an inlet end connected with a pressurized water source end, and an outlet end inserted into the drainage base and connected with the water outlet of the drainage base.

7. The integrated water fitting assembly according to claim 6, wherein each of the plurality of flushing aid tubes is a venturi tube, wherein the venturi tube has a gradually reduced diameter, the pressurized water source end is a flushing aid pump, wherein the flushing aid pump is integratedly disposed in the housing or the flushing aid pump is disposed on a side of the drainage base outside the housing, the inlet end of each of the plurality of flushing aid tubes is connected to the flushing aid pump through a flushing aid tubing, an anti-siphon hole is formed in an upper part of the flushing aid tubing, wherein the anti-siphon hole is higher than a working water level set in a water cavity, a water-passing cavity of the flushing aid pump is arranged inside the flushing aid pump, an impeller of the flushing aid pump is located in the water-passing cavity of the flushing aid pump, and a third water inlet of the flushing aid pump and a water outlet of the flushing aid pump are both communicated with the water-passing cavity of the flushing aid pump.

8. The integrated water fitting assembly according to claim 6, wherein the pressurized water source end is an external tap water supply tube, and a solenoid valve is arranged on the external tap water supply tube.

9. The integrated water fitting assembly according to claim 1, wherein the housing comprises an upper housing and a lower housing assembled and connected with the upper housing, the dual-outlet micro-pump is arranged on the lower housing, a filter screen is arranged at a position of a water inlet of the dual-outlet micro-pump, snapping members are arranged on two sides of an outer wall of the upper housing, each of the snapping members comprises a middle part fixedly connected to the upper housing and two ends being cantilevers, and each of the snapping members comprises an upper end being a pressing part and a lower end clamped with the drainage base.

10. The integrated water fitting assembly according to claim 1, wherein a water supplement tube and/or a water leakage tube is/are further arranged on the drainage base, the water supplement tube and the water leakage tube are communicated with the water outlet of the drainage base, and the washing water outlet is connected with a washing tubing.

11. The integrated water fitting assembly according to claim 1, further comprising a plurality of flushing aid tubes, wherein each of the plurality of flushing aid tubes comprises an inlet end connected with a pressurized water source end, and an outlet end inserted into the drainage base and connected with the water outlet of the drainage base.

12. The integrated water fitting assembly according to claim 11, wherein each of the plurality of flushing aid tubes is a venturi tube, wherein the venturi tube has a gradually reduced diameter, the pressurized water source end is a flushing aid pump, wherein the flushing aid pump is integratedly disposed in the housing or the flushing aid pump is disposed on a side of the drainage base outside the housing, the inlet end of each of the plurality of flushing aid tubes is connected to the flushing aid pump through a flushing aid tubing, an anti-siphon hole is formed in an upper part of the flushing aid tubing, wherein the anti-siphon hole is higher than a working water level set in a water cavity, a water-passing cavity of the flushing aid pump is arranged inside the flushing aid pump, an impeller of the flushing aid pump is located in the water-passing cavity of the flushing aid pump, and a third water inlet of the flushing aid pump and a water outlet of the flushing aid pump are both communicated with the water-passing cavity of the flushing aid pump.

13. The integrated water fitting assembly according to claim 11, wherein the pressurized water source end is an external tap water supply tube, and a solenoid valve is arranged on the external tap water supply tube.

14. The integrated water fitting assembly according to claim 5, wherein the dual-outlet micro-pump comprises a water-passing cavity, a rotatable rotor shaft is arranged in the water-passing cavity, an impeller is disposed on the rotatable rotor shaft, the first water inlet, the washing water outlet, and the drainage control water outlet are all communicated with the water-passing cavity, the first water inlet is formed at a bottom of the dual-outlet micro-pump, and the washing water outlet and the drainage control water outlet are eccentrically formed on a side wall.

15. The integrated water fitting assembly according to claim 14, wherein a pressure relief hole is formed above the washing water outlet or the drainage control water outlet, the impeller is of a spiral type, and the washing water outlet and the drainage control water outlet are inclined outward in a water flow conveying direction of the impeller.

16. The integrated water fitting assembly according to claim 6, wherein the dual-outlet micro-pump comprises a water-passing cavity, a rotatable rotor shaft is arranged in the water-passing cavity, an impeller is disposed on the rotatable rotor shaft, the first water inlet, the washing water outlet, and the drainage control water outlet are all communicated with the water-passing cavity, the first water inlet is formed at a bottom of the dual-outlet micro-pump, and the washing water outlet and the drainage control water outlet are eccentrically formed on a side wall.

17. The integrated water fitting assembly according to claim 15, wherein a pressure relief hole is formed above the washing water outlet or the drainage control water outlet, the impeller is of a spiral type, and the washing water outlet and the drainage control water outlet are inclined outward in a water flow conveying direction of the impeller.

18. The integrated water fitting assembly according to claim 5, wherein the drainage control water outlet of the dual-outlet micro-pump has a head of 3-10 m and a flow rate of 3-10 L/min; and the washing water outlet of the dual-outlet micro-pump has a head of 3-5 m and a flow rate of 12-18 L/min.

19. The integrated water fitting assembly according to claim 6, wherein the drainage control water outlet of the dual-outlet micro-pump has a head of 3-10 m and a flow rate of 3-10 L/min; and the washing water outlet of the dual-outlet micro-pump has a head of 3-5 m and a flow rate of 12-18 L/min.

* * * * *